US009646591B1

(12) United States Patent
Young

(10) Patent No.: US 9,646,591 B1
(45) Date of Patent: May 9, 2017

(54) SYSTEM, METHOD, AND APPARATUS FOR DETERMINING THE FRETTED POSITIONS AND NOTE ONSETS OF A STRINGED MUSICAL INSTRUMENT

(71) Applicant: Leroy Daniel Young, Smyrna, TN (US)

(72) Inventor: Leroy Daniel Young, Smyrna, TN (US)

( * ) Notice: Subject to any disclaimer, the term of this patent is extended or adjusted under 35 U.S.C. 154(b) by 0 days.

(21) Appl. No.: 14/997,488

(22) Filed: Jan. 16, 2016

Related U.S. Application Data

(60) Provisional application No. 62/105,786, filed on Jan. 21, 2015.

(51) Int. Cl.
*G10H 1/18* (2006.01)
*G10H 1/34* (2006.01)

(52) U.S. Cl.
CPC ..... *G10H 1/342* (2013.01); *G10H 1/187* (2013.01); *G10H 2220/165* (2013.01)

(58) Field of Classification Search
CPC .... G10H 3/18; G10H 1/348; G10H 2220/521; G10H 3/26; G10H 1/00; G10H 2220/301; G10H 1/32; G10H 3/188; G10H 3/185; G10H 1/0091; G10H 2210/066; G10H 1/02; G10H 3/186; G10H 1/0008; G10H 2220/165; G10H 2220/471; G10H 2220/485
See application file for complete search history.

(56) References Cited

U.S. PATENT DOCUMENTS 4,468,997 A * 9/1984 Young, Jr. ..... G10H 1/182 84/615
4,630,520 A * 12/1986 Bonanno ..... G10H 1/342 84/647
5,024,134 A * 6/1991 Uchiyama ..... G10H 1/342 84/654
5,990,408 A * 11/1999 Hasebe ..... G10H 1/0066 84/723
6,191,350 B1 * 2/2001 Okulov ..... G10H 1/0008 84/646
6,787,690 B1 * 9/2004 Celi ..... G10H 1/125 84/600
2005/0120870 A1 * 6/2005 Ludwig ..... G10H 1/00 84/661

(Continued)

*Primary Examiner* — Marlon Fletcher
(74) *Attorney, Agent, or Firm* — Patterson Intellectual Property Law, PC; Lucian Wayne Beavers; Grant M. Ford

(57) ABSTRACT

Systems, methods, and apparatuses may be used to determine fretted positions associated with a stringed instrument. Stringed instruments may be used for interfacing with at least one musical synthesizer interface. A specially-modified stringed musical instrument or system applied to a stringed musical instrument may be used to determine where a guitarist is pressing guitar strings against guitar frets (e.g., 'stopped positions' or 'fretted positions') without resorting to sending electrical current down the strings or having segmented frets. Special techniques may be used to determine when a pluck of a string occurs. A guitarist may be allowed to play a guitar in a normal manner and control a musical synthesizer or other sound generating device with the same level of predictability that keyboard players have enjoyed for years.

20 Claims, 6 Drawing Sheets

SYSTEM BLOCK DIAGRAM

(56) References Cited

U.S. PATENT DOCUMENTS

| | | | | |
|---|---|---|---|---|
| 2009/0084243 | A1* | 4/2009 | Pyper-Scott | G10D 1/08 84/293 |
| 2009/0100992 | A1* | 4/2009 | Elion | G10H 1/0066 84/646 |
| 2009/0260508 | A1* | 10/2009 | Elion | G10H 1/0066 84/646 |
| 2011/0011248 | A1* | 1/2011 | Elion | G10H 1/0066 84/646 |
| 2011/0132180 | A1* | 6/2011 | Gobbers | G10H 1/14 84/622 |
| 2012/0036982 | A1* | 2/2012 | Sullivan | G10H 1/383 84/724 |

* cited by examiner

Figure 1 SYSTEM BLOCK DIAGRAM

Figure 2 String-To-Gradient Wire Interaction

Period dependent envelope follower

Pitch Synchronous pluck detection flow diagram

Binary Sequence

| Fret Select | Multiplexer Select | Physical Fret Selected |
|---|---|---|
| | Top-most Mux | |
| 000 | 00 | 23 |
| 001 | 00 | 22 |
| 010 | 00 | 21 |
| 011 | 00 | 20 |
| 100 | 00 | 19 |
| 101 | 00 | 18 |
| 110 | 00 | 17 |
| 111 | 00 | 16 |
| | Middle Mux | |
| 000 | 01 | 15 |
| 001 | 01 | 14 |
| 010 | 01 | 13 |
| 011 | 01 | 12 |
| 100 | 01 | 11 |
| 101 | 01 | 10 |
| 110 | 01 | 09 |
| 111 | 01 | 08 |
| | Bottom-most Mux | |
| 000 | 10 | 07 |
| 001 | 10 | 06 |
| 010 | 10 | 05 |
| 011 | 10 | 04 |
| 100 | 10 | 03 |
| 101 | 10 | 02 |
| 110 | 10 | 01 |
| 111 | 10 | 00 |

BINARY CODING OF MULTIPLEXER SELECTIONS

FIGURE 5

Gray Code Sequence

| Fret Select | Multiplexer Select | Physical Fret Selected |
|---|---|---|
| | | Top-most Mux |
| 000 | 00 | 23 |
| 001 | 00 | 22 |
| 011 | 00 | 21 |
| 010 | 00 | 20 |
| 110 | 00 | 19 |
| 100 | 00 | 18 |
| 101 | 00 | 17 |
| 111 | 00 | 16 |
| Middle Mux | | |
| 111 | 01 | 15 |
| 101 | 01 | 14 |
| 100 | 01 | 13 |
| 110 | 01 | 12 |
| 010 | 01 | 11 |
| 011 | 01 | 10 |
| 001 | 01 | 09 |
| 000 | 01 | 08 |
| Bottom-most Mux | | |
| 000 | 11 | 07 |
| 001 | 11 | 06 |
| 011 | 11 | 05 |
| 010 | 11 | 04 |
| 110 | 11 | 03 |
| 100 | 11 | 02 |
| 101 | 11 | 01 |
| 111 | 11 | 00 |

GRAY CODING OF MULTIPLEXER SELECTIONS

FIGURE 6

SYSTEM, METHOD, AND APPARATUS FOR DETERMINING THE FRETTED POSITIONS AND NOTE ONSETS OF A STRINGED MUSICAL INSTRUMENT

CROSS-REFERENCES TO RELATED APPLICATIONS

This application claims benefit of U.S. Provisional Patent Application No. 62/105,786, dated Jan. 21, 2015, and which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to systems, methods, and apparatuses for determining fretted positions and note onsets of a stringed musical instrument.

1. Field of the Invention

Musical instrument players have a history of utilizing technology to allow their instrument to generate or control additional sounds. Certain violins and wind instruments, for example, have been physically and/or electronically modified to allow them to act as 'controllers' and thereby interface to external sound generating devices such as musical synthesizers. More universally, keyboards have had switches added to each key to generate on/off signals for controlling sound generation hardware and software. These so-called MIDI keyboards are generally regarded as highly reliable musical controllers. The guitar, although widely used in all types of music, has yet to have a reliable and cost-effective synthesizer interface instrument available to them. This deficiency is due not only to the lack of these instruments accurately determining fretted notes but also due to the unacceptable performance in detection of certain types of plucks ('note onset').

2. Description of the Prior Art

There have been numerous guitar-to-synthesizer interfaces disclosed but few have had commercial success. This is due to cost and/or performance limitations that have prevented widespread acceptance.

For example, so called waveform extraction interfaces, such as the Roland Corporation's commercially available GR series of guitar controllers, analyze the guitar's vibrating strings to determine what note is being played on a particular string. Such products suffer from slow responses due to the time necessary to reliably determine the period of the waveform (especially on lower frequency strings). This method is also notorious for generating unexpected 'chirps', wrong notes, added notes, and missed notes unless users are unnaturally precise with their playing style.

Other products have replaced the guitar strings with an array of buttons, sensors, or 'fake strings' (for determining what note is being played) and/or have replaced the plucking area of the strings with touch sensitive pads, joysticks, or another set of 'fake strings' (to determine when a pluck occurs). Instrument cost and the departure from natural guitar playing have prevented such 'virtual guitar' products from becoming widely accepted.

Other products have incorporated 'split frets' into guitar-like instruments for stopped fret detection. Specifically, each of the frets (22 frets, for example) is divided physically and electrically into segments, one segment for each string. Then each of the 132 segments (6 strings times 22 frets) is scanned to determine where each string is pressed. This solves string-to-string crosstalk problem that would otherwise cause issues for such a simplistic approach. However, this approach is fraught with problems such as high cost, difficulties in manufacturing, fret segments falling out, mistaken fret identities when a user 'bends' one string into an adjacent segment.

Other patents, including U.S. Pat. No. 4,468,997 by this inventor (now expired), U.S. Pat. No. 4,702,141 by Bonnano (also expired), have taught how to sequentially drive electrical current through the guitar strings and (1) sense resultant voltages at fret-string junctions along the current-carrying string as a means to determine stopped fret positions (Bonnano) or, (2) to sense voltage drops along the current-carrying string between fret pairs to determine stopped fret positions (Young). These methods allowed use on specially modified guitars having factory strings and factory frets. However, such methods of sequentially driving large amounts of current down the guitar strings had a myriad of issues including heating of the strings, calibration complexities, inadvertent introduction of switching noise into electromagnetic pickups on the guitar, and corrosion caused by high currents flowing through the dissimilar metal at the string/fret contact points.

Other patents have included descriptions of envelope followers for use in pluck detection and level detection for use in so-called Note Off computations. However, these followers have historically used fast-charge/slow discharge capacitors in an attempt to follow the peak movements of the waveforms. Although these followers are effective in following envelopes as they rise in energy, they are sluggish in following waveforms that decay very quickly. This results in delays in turning off notes and disruptive changes of tones.

BRIEF SUMMARY OF THE INVENTION

One objective of the present invention is to provide a device and method for rapidly identifying the highest 'stopped fret' on each string of a musical instrument without resorting to sending current down the individual strings or segmenting the frets. That is, identifying the highest fret that has a string pressed against it on a normal playing guitar.

A second objective of the present invention is to provide a device and method for rapidly identifying when a pluck of a string ('note onset') occurs and when the energy of the string has decayed below a predetermined threshold ('note off').

A third objective of the present invention is to provide a device and method for allowing playing of said musical instrument using only stopped frets movements in place of string pluck detection and string energy thresholds.

And, finally, a fourth objective of the present invention is to transmit commands, according to user inputs to a musical sound generator to allow playing a variety of tones.

According to the first objective of an exemplary embodiment of the present invention, in a stringed musical instrument, stopped fret positions are determined by:

(1) applying a set of small voltages to the frets themselves in a prescribed novel manner and, then (2) monitoring resulting voltages appearing on selected guitar strings as a result of the strings being pressed against various energized frets, and (3) progressively comparing the voltages appearing on said selected string to the actual selected fret voltages, and finally (4), applying "closeness" analysis algorithms to the results of the string-to-voltage comparisons to determine the highest fret(s) pressed.

According to the second objective of the present invention, in an stringed musical instrument having multiphonic pickups (one independent sensor per string), right hand string pluck detection may be accomplished by utilizing a novel envelope follower of each individual string's waveform using period-dependent methods and then analyzing specific voltage changes within that envelope to indicate note onsets. Further, a period-synchronous pluck detection method is disclosed which compensates for possible missed plucks when the envelope follower is lacking sufficient amplitude changes. And further, level detection accomplished by analyzing the envelope voltage changes to indicate when said envelope has fallen below a predetermined threshold.

According to the third objective of the present invention, in a stringed musical instrument, secondary Note On/Note Off information may be derived using only stopped fret information instead of pluck and energy information. Specifically, when a string's stopped fret changes from one fret to another fret or changes from an 'open string' to a stopped fret, this would cause a Note On command to be transmitted to a sound generating device. When a string is changed from a fretted position to 'open', then a Note Off command could be sent to the sound generating device thus allowing 'left hand only' and two-hand 'tapping' styles of playing.

According to the fourth objective of the present invention, in a stringed musical instrument, having derived Note On/Note Off triggers from plucks and/or fret stop information, properly formatted commands may be sent to an internal or external sound generating device either via MIDI or other interfacing means to allow the generation of tones according to mode selections from the user. Certain mode inputs may be obtained by selectively allowing string-to-fret closures on the instrument itself to be recognized as mode changes.

Numerous other objects, features, and advantages of the present invention will be readily apparent to those skilled in the art upon a reading of the following disclosure when taken in conjunction with the accompanying drawings.

BRIEF DESCRIPTION OF THE SEVERAL VIEWS OF THE DRAWINGS

FIG. 5 illustrates a binary sequence optionally used to select 1-of-24 frets according to an exemplary embodiment.

FIG. 6 illustrates a Gray Coding sequence optionally used to select 1-of-24 frets according to an exemplary embodiment.

DETAILED DESCRIPTION OF THE INVENTION

Figure 1:
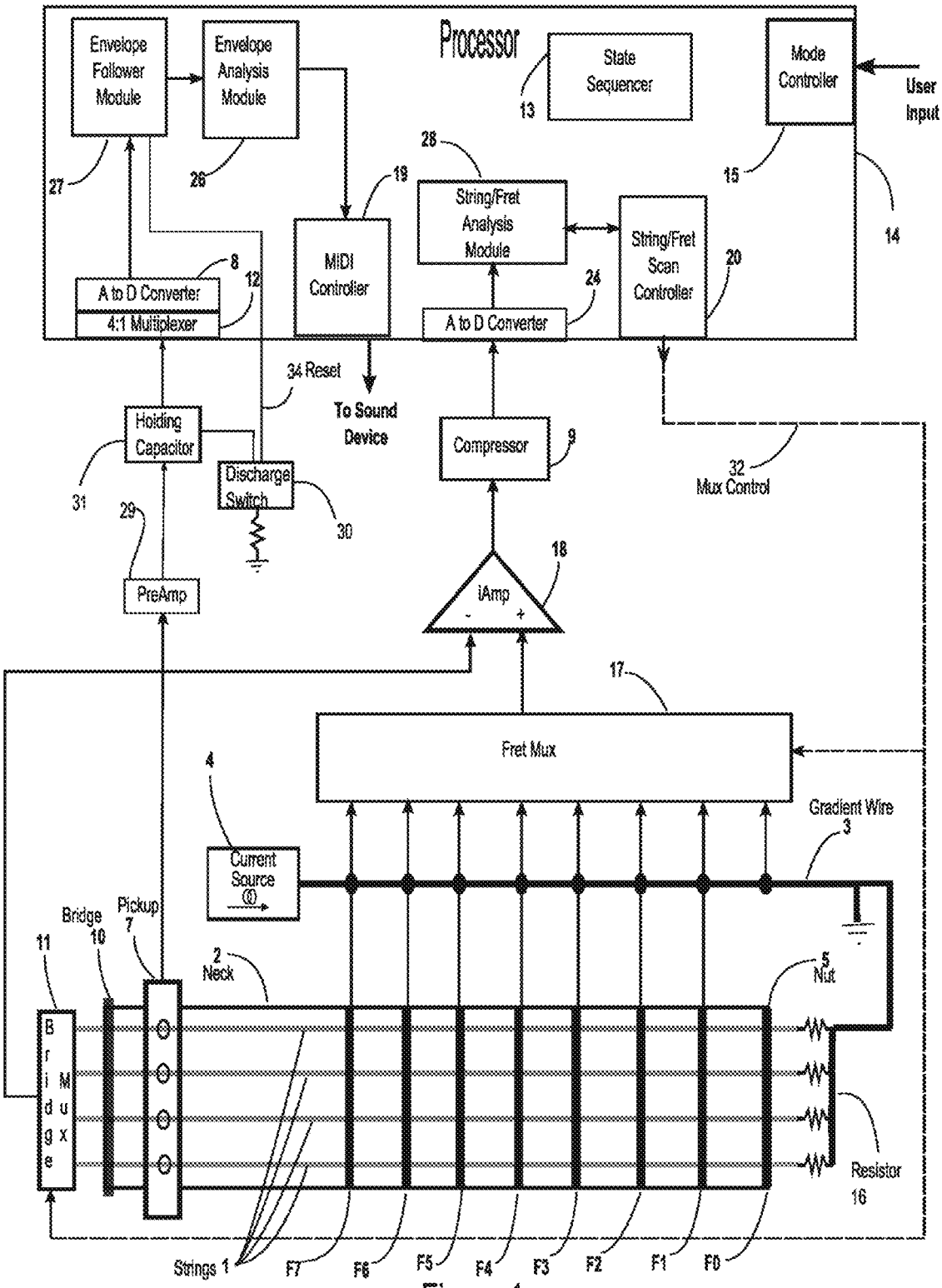
FIG. 1 illustrates a system block diagram depicting the various aspects of the present disclosure with reference to a guitar neck having 4 strings and 8 frets (Seven conductive frets and one 'virtual fret' at the 'fret 0' location) comprising physical elements (e.g., associated with the guitar itself) and software modules (e.g., associated with a processor) according to an exemplary embodiment.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Various exemplary apparatuses and associated methods according to the present disclosure are now described in detail with respect to FIGS. 1-6. Where the various figures may describe embodiments sharing various common elements and features with other embodiments, similar elements and features are assigned the same reference numerals and redundant description thereof may be omitted below.

Various embodiments of an apparatus according to aspects of the present invention may provide systems, methods, and apparatuses for determining fretted positions and note onsets of a stringed musical instrument.

We will now describe the general operation and interaction of the various elements of various embodiments of the present disclosure, followed by a detailed description of the dynamics of the fret voltages, followed by detailed step-by-step operation of exemplary embodiments.

(A) General

FIG. 1 depicts four conductive Strings 1 stretched across an elongated Neck 2, passing over conductive Frets F1 through F7 and over a multiphonic Pickup 7. Such a pickup may be of the multiple coil type or piezo saddles that are commercially available. Strings 1 are held in place at the 'bridge end' of the guitar by Bridge 10 and pass over the non-conductive Nut 5 at the 'nut end'. The strings are electrically isolated from each other and from any grounded elements of the guitar itself except for the resistive ground returns for each string at the nut end which will be described later. The tuning mechanisms, normally on such an instrument, are not shown in this figure for simplicity. The seven conductive frets, F1 through F7 are shown along with one virtual fret, F0, (at the nut) which will be described later. Guitars typically may have from 20 to 24 frets, typically 22, and from 4 to 6 strings but it should be obvious to those skilled in the art that the disclosed system would be scalable up or down to any reasonable number of frets/strings. Pressing a string against a fret is assumed to produce a low-resistance electrical connection between the string and one or more frets.

Gradient Wire 3 is connected via soldering or other conductive attachment means from fret to fret such that all frets are connected serially from one end of the neck to the other. The Gradient Wire 3, in the preferred embodiment, is a conductive steel guitar string having a size in the range of 0.015 inches. Current Source 4 delivers electrical current to one end of Gradient Wire 3, the other end of Gradient Wire 3 being grounded, allowing current to flow within Gradient Wire 3 setting up a voltage gradient along the wire. The seven Frets, electrically and physically connected along the Gradient Wire 3, will therefore have unique low impedance voltages imposed upon them. Having low tens of milliamps feeding the gradient wire gives rise to low unique voltage values at the frets which, when amplified by an appropriate factor, can give voltage levels that are easily processed.

Each of the seven connections of Gradient Wire 3 to Frets F1 through F7 are fed into the 8:1 multiplexer Fret Mux 17. The eighth input to Fret Mux 17 comes from a point on the Gradient Wire 3 where 'fret 0' would be located physically at the Nut 5. The selected output of Fret Mux 17 is controlled by String/Fret Scan Controller 20 within Processor 14 via Mux Control 32. Fret Mux 17 in turn feeds its single output into the positive input of the high-gain instrumentation amplifier iAmp 18.

The terminations of Strings 1 at Bridge 10, the 'bridge end' of the guitar, feed the 4:1 multiplexer Bridge Mux 11. The output selection of Bridge Mux 11 is controlled by String/Fret Scan Control 20 from within Processor 14 via Mux Control 32. The selected output of the multiplexer feeds the negative input of iAmp 18.

The output of iAmp 18 is fed to analog Compressor 9 which in turn feeds analog-to-digital converter A to D Converter 24 associated with Processor 14. The output of A to D Converter 24 is made available to software module String/Fret Analysis Module 28. The compressor, which is described later, alternatively can be incorporated into the iAmp by increasing the gain of the iAmp such that saturation occurs and only voltages around zero volts are in its linear range.

The Strings 1 at Nut 5, the 'nut end' of the guitar can be terminated in one of several ways. For example, the strings could feed a 4:1 multiplexer with the output of such a mux selectable via the Processor 14. The selected output of such a mux could be connected to ground via a small passive resistor which would then ground only the selected string. Having the 'open strings' ungrounded would allow detection of a users fingers against said open strings for producing such musical techniques as 'muting'.

Alternatively, and in the preferred embodiment, the individual strings are tied via individual small resistors (such as 10 ohms) to ground without the need for a multiplexer. Not only does this method save the cost/space of a multiplexer but having each string tied to ground at all times allows the guitar's normal pickups to operate without the hum and triggering noise that might be induced from finger touches.

Each of the four exemplary analog outputs of the multiphonic Pickup 7 is amplified by PreAmp 29 and fed into a sample/hold circuit (one of the four is shown in FIG. 1) consisting of Hold Capacitor 31 and Discharge Switch 30. The voltage peaks accumulated by the Hold Capacitor 31 are sequentially selected by 4:1 Multiplexer 12 and then converted to digital format by analog-to-digital converter A to D Converter 8 associated with Processor 14 and made available to Envelope Follower Module 27. Following the reading of the held voltage, the Hold Capacitor 31 is reset via a signal Reset 34 from the Envelope Follower Module 27.

Envelope Follower Module 27, within Processor 14, also receives stopped fret information of all strings from String/Fret Analysis Module 28 (connection line not shown). Mode information, received from the user, is available from Mode Controller 15.

Envelope Analysis Module 26 passes information regarding any derived plucks as well as envelope on/off status to MIDI Controller 19.

MIDI Controller 19, using mode control information, analyzes fret and string status, envelope information, and then formats appropriate commands for transmission or internal use. The MIDI output may be the industry standard 5-pin cable implementation or the more recent USB version. The musical generator itself may be implemented within embodiments discussed in the present disclosure, or may be available on external stand-alone synthesizers or within various types of personal computers.

The user interface, Mode Controller 15, receives external inputs from the user (from the guitar neck itself, switches, computer, or other means) for control of various operating modes (to be described later) and, in turn, allows displaying of status and user selections as appropriate.

(B) Fret Voltages and Loading Effects

The frets, connected at points along the length of Gradient Wire 3 will have unique voltages at each fret-to-gradient wire junction. (Notice on FIG. 1 that one input to the Fret Mux 17 does not come from a fret but instead comes from a point on the gradient wire itself where the nut, 'Fret 0', would have attached) These voltage junctions are fed to Fret Mux 17, then amplified (along with the selected string voltage via iAmp), compressed, and converted to digital format to be individually accessible by the Processor 14.

When a selected string is not pressed against any frets ('open string'), the voltages at each fret/gradient wire junction will simply be a function of the current flowing in the gradient wire and the length of the current-carrying gradient wire from that junction to ground. Further, when a selected string is not pressed against any frets ('open string'), the selected string voltage will be zero volts (due to the grounding of the selected string at the nut end via Resistor 16).

When an open string is pressed against a fret, the string voltage will change from zero volts and will quickly rise toward the stopped fret voltage. However, the loading effect of the now-pressed string will cause the previous 'open' fret voltage to change as the pressed string 'loads' the gradient wire.

That is, when strings are pressed against two adjacent frets (the normal fingering situation), the Gradient Wire 3 will see any pressed strings as a parallel resistance and portions of the gradient wire current will be diverted into the pressed strings via the fret/string electrical connections. This 'loading' by the guitar strings on the gradient wire will lower the voltage at that fret. This will create a 'new fret voltage' at that fret/string connection. Therefore, the specification of the resistance of the gradient wire is important for managing the loading interaction of pressed strings. The interaction of this 'new fret voltage' and the parallel strings will now be described.

If the resistance of the gradient wire is 'small' compared to the resistance of the guitar strings (i.e. a larger diameter wire or a more conductive wire), then the loading impact from the strings will be less. That is, parallel strings will not lower the fret voltage as much—but it will take more current to create adequate voltages for measurement. Conversely, if the resistance of the gradient wire is 'large' compared to the resistance of the guitar strings, it will take less current to create adequate voltages for measurement but the loading impact from the strings will be greater.

In one embodiment, it may be seen that using a guitar string similar to the 4th string of the guitar (approximately 0.016 inch) for the gradient wire, a balance is achieved between current requirements and loading. Obviously other sizes of wires or resistive wire or other material such as segmented elements could be used as the 'gradient wire' and tailored to the current source availability and/or loading impact.

(C) String-to-Fret Resistances

When a string is pressed against a fret pair, the string, in the best case, would assume the same voltage (the 'new fret voltage') as the highest fret it is touching. But this is only true if (1) the string is pressed firmly against the fret, and, (2) the contact resistance between the pressed string and the fret is essentially zero, and (3) there is no voltage offset in the fret and string paths from the guitar neck/strings to the iAmp. However, practically speaking, the contact resistance is not always zero, the player is not always pressing firmly, and, there will be offsets. Therefore the voltage on the string will not necessarily be the same as the voltage on the highest fret it is touching. For reasons to be explained in the next paragraph, the voltage on the string, when measured at its input to the iAmp, in the absence of offsets, can fall somewhere between being equal to the voltage on the highest fret that it's touching to being slightly higher than the voltage on the next lower fret.

Figure 2:
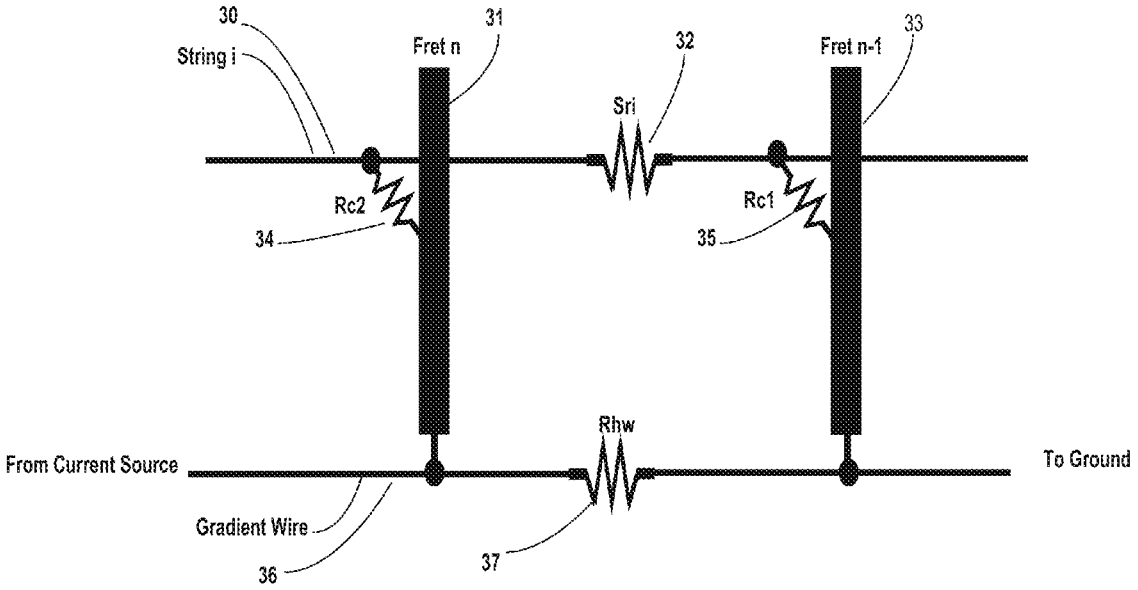
FIG. 2 illustrates electrical connection of a guitar string pressed against two adjacent conductive frets detailing the contact resistances that influence the various voltages according to an exemplary embodiment.

To clarify this, FIG. 2 shows a circuit diagram of two frets, Fret n 31 and Fret n-1 33, bridged by the Gradient Wire 36 and a single guitar String i 30. The Gradient Wire's connection to the fret has essentially zero resistance since it is soldered in place. However, String i has inherent string-to-fret contact resistances (Rc1 35 and Rc2 34). These two wires (the Gradient Wire and the String) create a resistive matrix comprising voltage gradient wire resistance Rhw 37, series string resistance Sri 32, and contact resistances Rc1 35 and Rc2 34. Rhw and Sri are both fixed resistances (depending on size of the parallel guitar string and the size of the voltage gradient wire being used). However, the contact resistances, Rc1 and Rc2 will vary with the pressure being applied by the fretting action and by the cleanliness of the string/fret contracts. Rc1 and Rc2 can vary from very nearly zero when pressed firmly onto a corrosion-free contact to nearly an open circuit when the string is not pressed firmly and/or when the contact has become corroded.

When the string is pressed firmly onto a clean contact point, the voltage that would be seen on String i at the left-most string junction will be essentially the same as the voltage on Fret n. As the string is released and/or the contact resistance increases, the voltage on String i at the left-most string junction will diminish as it is divided primarily by the ratio of the resistors Sri and Rc2 and will tend to approach the voltage on Fret n-1 as the contact resistance Rc2 increases.

In summary, the string voltage, in the absence of circuit offsets, will vary from being equal to the voltage on the highest pressed fret to being equal to or just above the voltage on the next lower fret, depending on fretting pressure and string contact resistances. However, voltage offsets within the path from the neck junctions, through the multiplexers, to the iAmp input and from the bridge string junctions, through its multiplexer, to the alternate iAmp input, may shift the voltage causing the string voltage to vary from being just above the voltage of the highest fret pressed and/or to just equal to or just higher than the next lower fret voltage. Therefore, since the string voltage, at the iAmp, can erroneously appear to be above the stopped fret and very close to the next lower fret, the scanning module must take this into account in order to identify the proper stopped fret. This methodology will be explained below in the fret scanning section.

Note: Independent of any combination of string loading anywhere on the neck, the voltage on any fret will always be higher than any fret 'below it' (closer to the nut end of the neck). That is, if a particular fret voltage is lowered due to parallel strings being pressed against it, the diminished voltage on that particular fret will still be greater than the voltage on any fret below it since all fret voltages below the diminished fret voltage will be similarly diminished.

(D) String and Fret Scanning and Analysis

We will now describe how the String/Fret Analysis module 28 takes the previously described dynamic voltage changes into account as it scans the strings/frets to produce accurate and robust 'slicing' of the compressed iAmp voltages for stopped fret detection. 'Slicing' herein is defined to be the analysis and segmenting of the string/fret voltages to ascertain the highest stopped fret.

To find the highest stopped fret on a string, the process is as follows: String/Fret Scan Controller 20 selects (via Bridge Mux 11) a string at the bridge-end to connect to the negative input of the iAmp. String/Fret Scan Controller 20 then selects a fret via Fret Mux 17 to be input to the positive input of the iAmp 18.

iAmp 18, a high-gain low-offset instrumentation amplifier (e.g., analyzer), may amplify and 'subtract' (e.g., compare) these two selected voltages present at its inputs—the fret voltage and the string voltage. This subtraction may be accomplished by the inherent 'differencing' and amplification of the two voltages at the inputs to the iAmp, the output then being the difference between the two selected voltages (e.g., comparing). This difference is an indication of the 'closeness' of the selected string voltage to the selected fret voltage. That is, if the selected fret voltage and the selected string voltage are exactly equal, the output of iAmp 18 will be zero. If the selected fret voltage is greater than the selected string voltage, the output of the iAmp will be positive. And, finally, if the selected fret voltage is less than the selected string voltage, the output of the iAmp will be negative.

In the most general terms, the highest stopped fret is defined to be the highest (first) fret where the output of the iAmp is 'very close' to zero volts. Therefore, it is not necessary to have the entire range of voltages present at the iAmp output in order to determine the stopped fret. That is, the critical iAmp output voltages needed to determine the highest stopped fret reside 'very close' to zero. Again, if the output of the iAmp is a large positive voltage or a large negative voltage, that means that the scan is not close to the stopped fret and such iAmp voltages are less critical.

To take advantage of this observation and to 'expand the view' of the area around zero volts from the iAmp, the iAmp is shown followed by Compressor 9. This compressor further amplifies the voltages near zero volts but compresses higher voltages, both positive and negative, to positive and negative 'ceilings' respectively. This dramatically increases the 'head room' for the inspection of critical voltages around the level of interest—zero volts—prior to the A to D conversion. As described previously, the Compressor 9 may be an integral part of the iAmp by appropriately adjusting the gain and offset of the iAmp such that voltages outside the desired range go into saturation.

The compressed output, whether from a modified iAmp or from Compressor 9, is then processed in one of two ways. First, as shown in FIG. 1, the compressed output is sent to the A to D Converter 24 and then on to the software String/Fret Analysis Module 28 for processing.

Alternatively, the compressed voltage can be 'sliced' using a combination of external hardware and the Analysis Module. Specifically, a comparator, such as a commercially available LM311, may be used to determine if the compressed output is above or below some adjustable reference voltage. The output of the comparator will be either a positive voltage or a negative voltage and may be viewed as a one-bit A to D converter. This reference voltage may be set as needed by the user or preset as part of the manufacturing final testing.

The sequence of scanning the frets from the highest fret to the lowest fret on a single selected string will now be described (other scan sequences will be described later).

In this sequence, for a selected string, the frets are sequentially selected from the highest fret to the lowest fret (finally including the 'open string' which is also called Fret 0). At each selected fret, String/Fret Analysis Module 28 analyzes the compressed output either from the A to D converter or from the comparator as described previously. For all selected frets above the stopped fret, the compressed output will be positive.

However, when the selected fret is the same as the highest stopped fret, the Compressor output will be 'near zero volts'. Due to the offsets and fret-to-string contact uncertainties, the absolute polarity and magnitude of the compressor voltage cannot be predetermined. That is, as described earlier, the string voltage created by a stopped fret may range from being slightly higher than the next-lower fret all the way up to being to slightly higher than the stopped fret voltage. Therefore, the compressor output, when the highest stopped fret is the selected fret, may be a slightly positive voltage or a negative voltage or even 'chattering' around zero volts—depending on fret pressure, contact cleanliness, offsets, etc. Obviously, an accurate slice cannot be made based on such variables.

To alleviate this uncertainty, a novel slicing approach is implemented which relies not on the compressed voltage of the highest stopped fret but on the compressed voltage of the next fret below the stopped fret. Keep in mind that when the string voltage is higher than the stopped fret voltage (which can be due to offset) the compressor output will be negative. We therefore set a slicing point, either within the software module or at the external comparator, that is slightly more negative than the largest expected offset voltage. Such a slicing point will force the highest stopped fret to have a positive compressor output when selected and will prevent the highest stopped fret from being detected as such.

That is, even when a stopped fret is pressed cleanly, even with offset present, the compressor output will still be positive and the scanner will continue scanning. Then, at the first NEGATIVE compressor output, we will know that the PREVIOUS fret was actually the highest stopped fret.

Again: If the stopped fret has not been found and a selected fret is the first fret to have a negative compressor output, then the actual stopped fret is the previous fret.

As described earlier, the string voltage, plus any offset, may be equal to or slightly greater than the stopped fret voltage. Therefore, the offset to the fret voltage, referenced above, moves the detection threshold away from any expected offset and thus allows robust stopped fret decisions to be made with a much lower possibility of 'chattering' when the fret and the string voltages are very close to one another.

Further, String/Fret Analysis Module 28, as well as the external comparator, has the capability to create hysteresis on the fret offset voltage to prevent chattering from fret to fret in this critical switching area.

If all frets are scanned/compared and no string is found to be pressed against any fret, the default is to label Fret 0 ('open string') as the 'stopped fret' for that string. After completing a scan on one string and storing the stopped fret number, String/Fret Analysis Module 28 selects another string and performs a similar scan on that string, etc. etc. In one exemplary embodiment, the fret-to-fret scanning can be comfortably performed at a 20,000 Hz rate.

NOTE: The scanning of the frets is an ongoing time-shared process, controlled by State Sequencer 13, which allows continuous updating of the stopped fret values while other complementary activities are being processed. Such a State Sequencer may exist as software flow within a processor and may be driven by in-line code, timing loops, or interrupts depending on the time critical nature of the various modules. For example, during scanning of the frets, the selection of the string and the fret is done and then a 'wait time' is initiated to allow settling of the iAmp, Compressor, and A to D converter before reading the A to D converter output. Other 'housekeeping' tasks could be addressed during this wait time to expedite the overall flow. Those skilled in the art of real-time processor control flow will understand the trade-offs that are associated with writing such code.

(E) Envelope Follower

Pickup 7 is placed such that one independent sensing element is beneath each string near the Bridge 10 constantly sensing that string's vibrations. Those string waveforms are each independently amplified, sample/held, selected, and the result converted to a digital format via A to D Converter 8, and sent to Envelope Follower Module 27.

Within Envelope Follower Module 27 is the envelope follower software routine. The envelope follower process may track the peaks of the string's absolute values in a period-dependent manner. That is, the updating to the follower is based on the period of the note being played on the selected string as dictated by the current stopped fret or based on the period of the lowest expected note on the selected string.

Typical hardware envelope followers use a 'leaky' capacitor to capture a string's waveform peaks. That is, they use controlled decay of a capacitor to allow the follower to track downward movement of the overall waveform. However, such followers are usually designed for 'worst case'. That is, they are designed not to decay 'too rapidly' in order to prevent excessive ripple in the envelope but yet 'slowly enough' to follow the outline of the peaks of the waveform. Such constraints prevent the envelope follower from tracking fast decays ('dropouts') which occur normally in guitar playing styles such as staccato picking.

However, this present application's envelope follower is not subject to the time constant of a fixed capacitor but, rather, the follower values are dynamically updated at a rate 'just slightly slower' than the frequency of the current string's waveform. That is, String/Fret Analysis Module 28 has previously stored the stopped fret number for the currently selected string and, via a table lookup, can supply period information to Envelope Follower Module 27 for the envelope follower routine. By allowing the envelope follower to update at a period slightly greater than the period of the current string's waveform, the envelope follower can be made very agile, quickly following the ebbs and flows of the input waveform.

Figure 3:
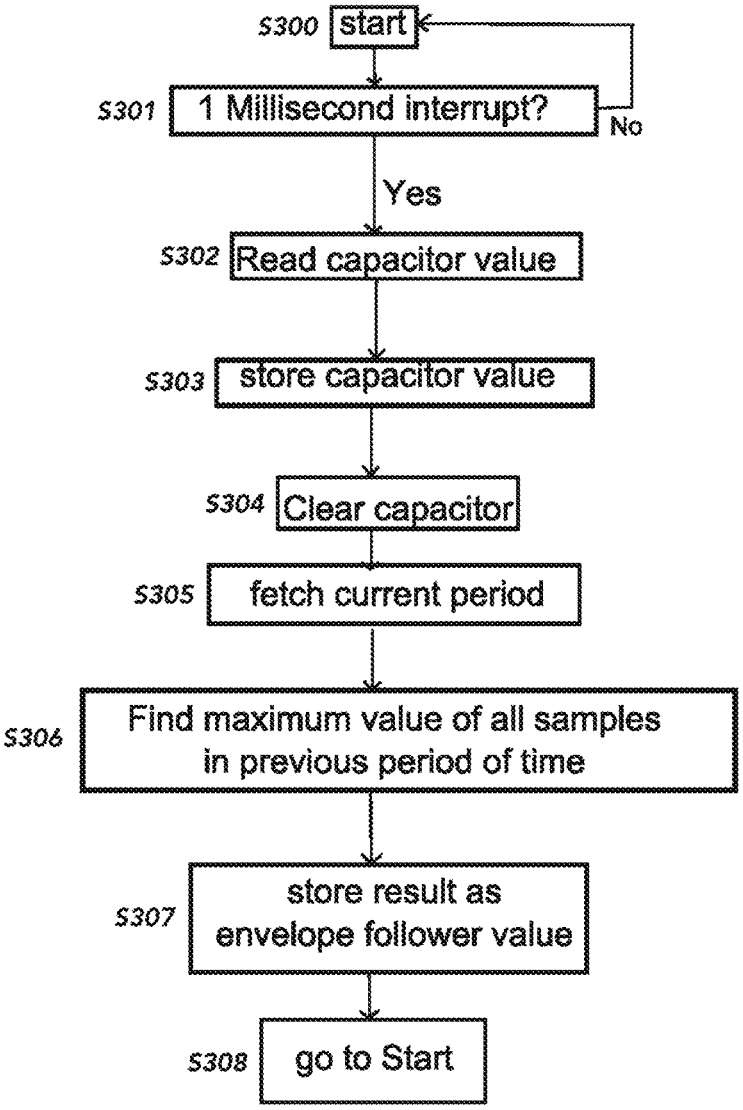
FIG. 3 provides a flow chart depicting operation of a period-dependent envelope follower useful for pluck detection in accordance with an exemplary embodiment.

As illustrated by FIG. 3, a period dependent envelope follower may begin at step S300. At step S301, it may be determined whether there is a 1 millisecond interrupt. If it is determined at step S301 that there is no 1 millisecond interrupt, the process may return to step S300. If the result at step S301 is positive, the process may continue by reading a capacitor value. The read capacitor value may then be stored at step S303. The capacitor may then be cleared at step S304. A current period may be fetched at step S305. At step S306, a maximum value of all samples in a previous period of time may be found. The result of step S306 may be stored as an envelope follower value at step S307. The process may then continue by returning to step S300 at step S308.

Referring to FIG. 1, which shows one of the four strings' circuitry and FIG. 3 which shows the software flow, the operation of this new follower in an exemplary embodiment will be described. One of the four strings is sent to a PreAmp 29 where the signal is boosted to appropriate levels. PreAmp 29 then feeds its signal to a non-drooping Holding Capacitor 31 where the string's peak amplitude is held. At the next sample time, the value of that held peak value is read by the processor, converted to a digital value and stored. The capacitor is then discharged by the processor and allowed to start tracking the waveform again. This process is repeated at a relatively slow rate (1000 samples per second, for example) with a sufficient number of the samples retained by the processor to constitute more than a full period of the current note.

Then, at the end of each sampling/storing/clearing of the capacitor, the Envelope Follower routine can then 'look back' at the stored samples, saving the most positive value that has occurred during a duration equal to slightly greater than one period's worth of samples. This value is then the current envelope follower value. This analysis and updating can occur at the sample rate and will therefore effectively calculate the envelope follower values at an exceedingly high rate.

Alternatively, the required period duration can be preset for each string such that the updating is done at a period just slightly greater than the longest period of that particular string.

Using this method for staccato playing, wherein the player produces only short bursts of energy, envelope follower consistent with the present disclosure can detect the end of the waveform burst between one and two cycles of the string's frequency.

More specifically, samples are input from the A to D Converter 24 at a sampling rate of, for example, 1 kHz having a period of 1 millisecond per clock time. Further, if, for example, string 6 is being followed and the stopped fret is fret 5, then the frequency of that string's vibration, on a normal guitar, would be 110 Hz with a period of approximately 8 ms. Therefore, there would be 8 samples of inputted data saved and available at each sample of the input waveform. If we updated the envelope follower every sample, for example, and looked back over 9 to 10 samples, we'd guarantee that the follower would always see a peak of the waveform fundamental.

(F) Note on and Note Off Process

When a user strikes a particular string with a plectrum or with a finger, that string's waveform amplitude typically increases in a step-function manner and will be captured by the envelope follower as previously described. By observing such changes and comparing to a predetermined threshold, the note detection routine within Envelope Analysis 26 can detect appropriate instances of increases and make decisions as to which increases constitute 'pluck events'. Further, by noting the amplitude of the envelope follower during or just after a pluck event, Envelope Analysis 26 can also identify the 'strength' of the pluck for use in the MIDI Controller 19 module.

A waveform strength routine within Envelope Analysis 27 keeps track of the amplitude of the envelope follower. When it detects that the envelope has dropped below a predetermined threshold, it generate a 'Follower Off' event to send to MIDI Controller 19.

For example, when MIDI Controller receives a Pluck event from the Envelope Analysis routine, it then retrieves the current fret number from String/Fret Analysis 28, the 'strength' of the pluck from the envelope follower module and composes/transmits a Note On command to the MIDI device. When it receives a Follower Off event from the Envelope Analysis module, it retrieves the note designation from the previously sent Note On command and composes/transmits a Note Off command for that note to the MIDI device.

(G) Alternative Pluck Detection Method

Monitoring the envelope strength changes as a means of detecting pluck events is effective for most expected input waveforms. However, there are pluck situation that can 'fool' the envelope-based detection. Specifically, missed plucks may occur when a low frequency string is being plucked at a very rapid rate (10 times per second, for example) especially if the player is not changing frets. The mass of the string and the same-fret high frequency plucking tend to cause the envelopes to sustain between plucks rather than decay. Without the decay, there may be no noticeable increase in energy and therefore plucks may be missed. Therefore, exemplary embodiments consistent with the present disclosure may use a secondary method of pluck detection that comes into play in situations where the envelope follower method may fail.

This secondary method relies on the fact that the frequency of the sounding note is known since the fret and string are known. Therefore, pitch synchronous methods may be employed. The basis of this alternate pluck detection method is the assumption that during the 'steady state' of a waveform, adjacent cycles are very similar, but during a pluck, the amplitude and/or the phase of the input waveform will change. In particular, in the absence of sufficient envelope follower amplitude changes, phase changes become a critical detection criteria.

Figure 4:
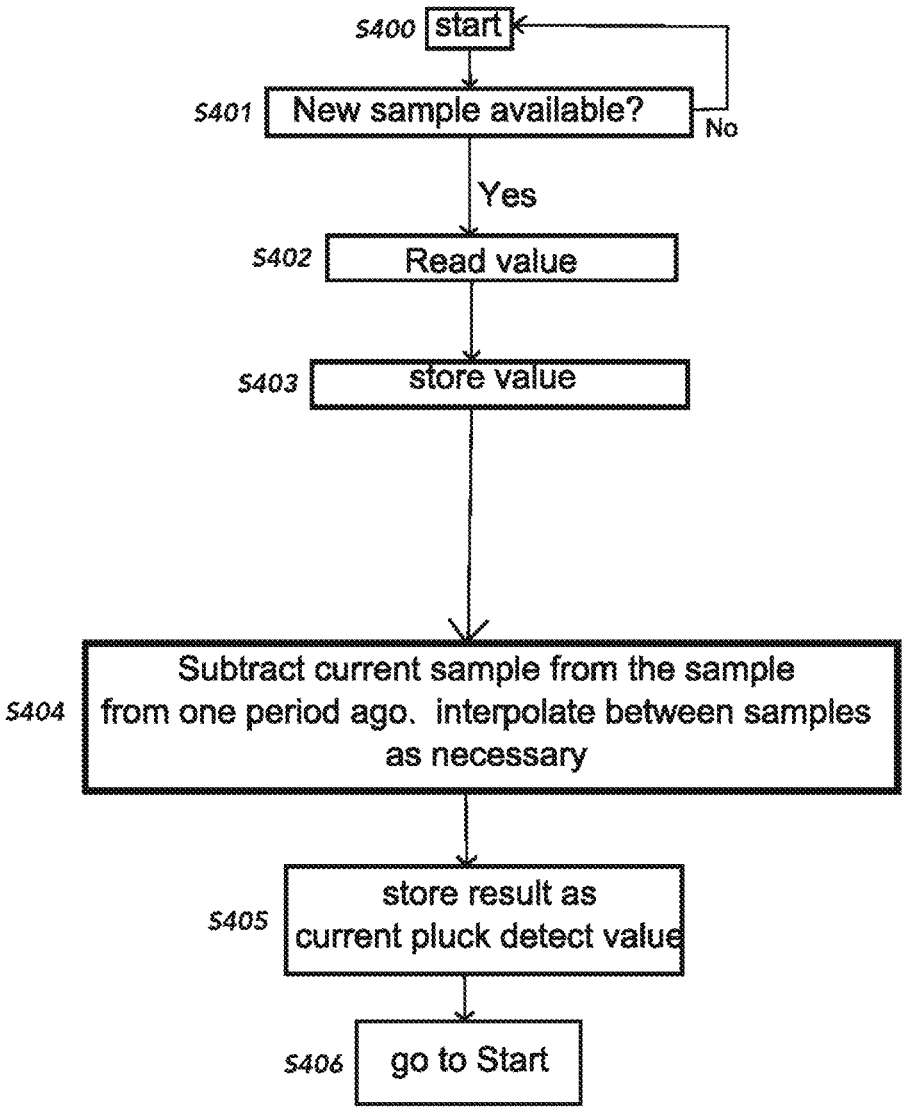
FIG. 4 provides a flow chart outlining the period-synchronous method of pluck detection according to an exemplary embodiment.

This exemplary embodiment may use a low-CPU usage method for detecting phase changes. FIG. 4 illustrates an exemplary pitch synchronous pluck detection flow consistent with the present disclosure. The process may begin at step S400. It may be determined at step S401 whether a new sample is available. If the result of step S401 is negative, the process may return to step S400. If it is determined at step S401 that a new sample is available at step S401, a value may be read at step S402. The read value may be stored at step S403. At step S404, a value of the current sample may be subtracted from a sample from a previous period (e.g., the previous period). Step S404 may include interpolating between samples as necessary. A result may be stored as a current pluck detect value at step S405. The process may continue by returning to step S400 at step S406.

In general, samples of the input waveform are compared to samples that occurred exactly one period earlier and the difference noted (Depending on the sample rate, some interpolation between samples may be required to get an accurate one-period comparison point). For a steady state input waveform, the difference between 'this sample' and the sample from one cycle ago will be 'small' since the waveform is changing very little from one period to the next. However, during a pluck, the phase between adjacent periods will 'jump' and give a larger difference between sample points. By applying a threshold to these differences, a highly reliable pluck detector can be created for these fast pluck situations.

This alternative pluck detection may be relied upon when the strings being interrogated are the lower strings, particularly on non-changing frets, and when phase-based pluck detector is showing fast plucks and the envelope follower pluck detector is not.

(H) Left Hand Only Mode

Since the present disclosure does not rely on analysis of the string's vibrations to determine the note being play, users can play in a so-called 'Left Hand Only' mode. In this mode, the user can cause notes to be sent to the synthesizer merely be touching a string to a fret. Stopping the note(s) is accomplished by releasing the string, allowing the string to go 'open', thus signaling the MIDI Controller to send the appropriate 'Note Off" commands. This also allows so-called 'tapping' where the user taps frets using one or two hands on the neck. Since the scanning reacts to the highest fret pressed, tapping can be accomplished using two hands even on a single string, tapping and releasing notes as desired.

(I) Scanning Alternatives

Scanning can proceed in the previously-described cyclic manner covering all frets on single strings and progressing repetitively through all strings. Alternatively, to expedite the scanning process, once a stopped fret is found on any string, scanning of that string may cease (having stored the stopped fret results for that string) and the string control can move to the next string. This decreases the time necessary for a complete scanning cycle. It may be advantageous in various embodiments to have this 'skipping' selectable within the software as a mode. For troubleshooting, having all strings scan all frets allows a predictable sequence of events for observation. For actual playing of the instrument, allowing the described skipping speeds up the scan time and makes the instrument more responsive.

Other scan sequences may be used to further minimize the time required to do a complete scan as follows. Instead of scanning every fret from the highest numbered fret to the lowest one, we can instead select frets in a specific expedient order. For example, we could begin the scan by checking for an 'open string'. That is, select Fret 0 and check the status of the Compressor output. If the Compressor output is positive we can deduce that the string is not being contacted at or above Fret 0 since if the string were depressed above that fret, the Compressor output would be negative. We could therefore conclude that the string is 'open' and move immediately to the next string. However, if the output from Compressor is negative when Fret 0 is scanned then the string must be pressed at higher fret. Knowing then that a fret is pressed somewhere on that string, we can take steps to determine the fret stop point either by scanning from the highest sense wire as previously discussed or by using a shortcut method as follows.

Since the Compressor output goes negative and stays negative during the scan of sense wires below the stopped fret, a form of successive approximation can be used to find the stopped fret more quickly. That is, we can first look at Fret 0 to determine if the string is open and, if not, select a fret 'near the center' of the neck and analyze Compressor output. Depending on that output we would then either look at the ¾ point or the ¼ point. Depending on the results of that next interrogation we would then look at points ⅛ on either side of that point and follow that strategy until the correct fret stop is found. As noted earlier, a stopped fret requires that you locate a fret pair where the higher fret has a positive Compressor output and the next lower fret has a negative Compressor output.

For 22 frets, a stopped fret may be found within 1 interrogation if the string is open or within 6 interrogations if there is a fret stopped. Therefore, if a player is playing single-note melodies where 'most' strings are open except the melody string, then we can do a full scan of all six strings in 11 interrogations—6 for the string being played and one each for the remaining open strings. A full 22 fret scan would take 134 interrogations in a straightforward scanning method so there is a substantial savings in time—6 vs. 134 if all strings are open; 11 vs. 134 if single-note melodies are being played; and, 36 vs. 134 if barre chords are being utilized.

Other methods of scanning are possible. For example, instead of scanning each string as if the fret number is unknown, we could store the previously found fret number on that string and use that as the starting point for the next scan of that string. Since the scanning rate is very high, there are perhaps hundreds of scan times between each change of notes. Therefore, it may be possible to find the pressed fret using this historical basis within two scan times of the string. By coupling this method with the 'check for open' method, a complete scan sequence could be done very quickly.

Other versions of scanning may be incorporated in accordance with the present disclosure, such as delayed or priority decision scanning. In these modes, the stopped fret decision is delayed and/or modified to alleviate certain undesirable note activity especially when using tapping modes. For example, when tapping, the string may hit the next-lower fret just before hitting the final fret. Due to the high speed of scanning, this next-lower fret's note could be sent to the sound generator followed by the 'real note'. This short burst of the incorrect note followed by the note-on of the correct note is referred to as chatter. To alleviate this chatter, two actions are available. In a first method, any stopped fret that is found after an open string state is assumed to be an incorrect note and no note-on is sent but a delay is initiated. After 3-5 milliseconds, for example, if no new note is found, then a note-on is transmitted for the original note. If a different follow-on note is detected during the delay, it is assumed to be valid and is sent immediately to the sound generator. This method may introduce a slight delay from a fret touch to note activation but is effective is decreasing the chatter issue.

A second method, which does not delay the note-on activation, uses bending as a corrective measure. Specifically, when a stopped fret is detected, the note-on is sent for that fret immediately and a delay is initiated in software. If a follow-on note is detected during the delay period, then a MIDI message is sent to the sound generator that causes the original note's value to be modulated to the value of the new note. This 'gliding' of one note into another is far less noticeable than the disruptive double note-on.

Priority scanning is used to give more keyboard-like playing. For example, when playing chords, the software can be put into a mode called 'High Fret Priority'. In this mode, stopped fret detections on any particular string are only allowed to be valid if they are higher than previously detected stopped frets. So, the player can depress multiple frets of a chord without any downward notes sounding on when he releases the chord. As soon as a string achieves an open state, the priority is released anticipating the next fretting actions. Systems consistent with the present disclosure may be implemented such that the High Fret Priority comes into play only after more than 2 strings, for example, have been activated. This allows solo playing without the high fret constraint while still allowing 3 or more strings to play the 'high priority' keyboard style.

(J) Modes and Mode Control

Implementations consistent with the present disclosure may operate in at least two major modes. As described earlier, the user can cause sound generator note initiation by relying on pluck detection on the right hand—'Pluck Mode'. And, as an alternative or in combination, the user can cause note initiation activated by fret changes on the left hand or by fret changes cause by both hands touching and releasing strings onto the fingerboard—"Tapping Mode". Within each of those two major modes, there are several sub-modes. For example, the player could be utilizing Tapping Mode with his left hand but still be plucking strings with his right hand but not having the plucks causing any note initiation. This mode may be referred to as 'double play' since the two activities are being done somewhat independently.

Additional modes are: For example, the user can choose to change the octaves on one or more strings; or change the synthesized sound that is generated on each string; or change the sounds generated by any or all frets on a given string; or change the 'meaning' of each note on the strings. This latter mode is powerful in that it allows a totally new set of tools to be made available to the guitarist.

This redefinition of fret-to-note meanings depends on the fact that the fret number that is supplied by the String/Fret Analysis is strictly a positional indicator—not necessarily a musical indicator. That is, any fret position can be caused to generate any synthesized note or any combination of notes. This is done using a well-known technique referred to as 'look-up tables'. Having a selection of tables allows any physical positional input to be converted to any desired musical result. For example, rather than having each fret generate the 'expected' musical note, a fret-to-note converter table can be created such that only major scale notes are generated on any fret, or only notes of a so-called Blues scale are generated, or only the notes of any of the hundreds of known scales/modes are generated. Further, using a special table, a single fretted position could be caused to generate multiple notes for use in 'one finger chording' or even pattern-based 'short hand' chording. One such fret-to-note conversion that raises interesting musical possibilities is an 'upside down' mode where the notes of the strings are generated descending rather than ascending as a player fingers up the neck. Then by using appropriate playing techniques, a musician can play harmonies between the actual guitar notes and the synthesized notes.

As an added bonus, because of the available positional information from the scanning mechanism, plucks can be enabled or disabled based on fretting activity. That is, if desired, the plucks can be enabled only for open strings (valuable for activating open strings where there is no tapping position for open strings). Or, plucks could be enabled only for certain strings or for certain areas on certain strings. This would allow harmony notes to be generated when the player is fretting notes that are within some preselected mode or scale.

These modes and many others that can be defined, may be selected by the user on embodiments consistent with the present disclosure using only the neck and an enable signal. For example, pressing a dedicated button on the body of the guitar could change the positional information derived from the neck scanning from being note detection to being mode information. For example, pressing the enable button and then pressing the 5th fret of the 1st string could cause the mode to change to 'upside down scales'. Pressing the dedicated button and then pressing another fret could change the mode to 'Left Hand Only' etc. etc. Further, the enable button could also be implemented using a foot switch or even another fret on the neck. Implementations consistent with the present disclosure may an enable button by using the highest fret on string 6—a fret that is normally unused by guitarists.

(K) Multiplexer Control Process

Fret Mux 17 may typically comprise multiple commercially available multiplexers. For example, to scan 24 frets, three 8:1 multiplexers such as CD4051 or the like, could be used in combination. Such multiplexers have 3 control inputs to select one-of-eight inputs then an additional input to enable the multiplexer. Therefore, three fret selection multiplexers could be controlled by a total of 5 signals from the processor 15—3 signals to pick one-of-eight paths within all three multiplexers and then two other signals decoded to pick one of the three multiplexers.

These 5 signals, depending on the processor in use, may come from different ports on the processor and therefore it may not be possible to change them 'all at once'. Unfortunately, changing the control signals in a non-synchronous manner can lead to substantial glitch problems. For example, if the multiplexer select decoding is changed first, while holding the fret select constant even for a few microseconds, then the output of the multiplexer group selection output will 'jump' from the fret position selected on the first multiplexer to the same fret position of the next selected multiplexer. This will cause an amplified spike on the output of the iAmp. Similarly, changing the fret selection, while holding the multiplexer selection constant, will cause a fret-to-fret voltage jump within the same multiplexer which will also create a spike. These spikes interfere with the slew rate of the iAmp and essentially slow down the potential speed of scanning.

To alleviate this problem, a novel selection sequence of the frets and the multiplexers is disclosed utilizing a binary sequence referred to as Gray Coding. Gray Coding, unlike normal binary coding, only allows changes in a binary sequence one bit at a time. That is, rather than scanning in a normal binary fashion such as: 000, 001, 010, 011, 100, 101, 110, 111, the Gray Code sequence would be: 000, 001, 011, 010, 110, 100, 101, 111. Notice that only one bit changes at a time between any Gray-coded three-bit values and notice further that the end points (000 and 111) remain the same as in the binary sequence.

FIG. 5 shows the 5 bit coding sequence table that would typically be used to select 24 frets. Notice that numerous transitions (10 total) where multiple bits are changing at a transition point. These transitions points are underlined in the table and therefore could give rise to the aforementioned problematic glitching. The right-most column in FIG. 5 shows the fret that would be selected by the fret and multiplexer codes on the same line.

The novel method of controlling the multiplexers to alleviate this glitching utilizing the previously described Gray Coding is shown in FIG. 6. Instead of having the selection sequence be 'standard', the proposed method selects the inputs 'out of order'—per the Gray code. That is, instead of selecting the multiplexer inputs as 0, 1, 2, 3, 4, 5, 6, 7, this disclosed method selects the inputs of the top-most and bottom-most multiplexers as 0, 1, 3, 2, 6, 4, 5, 7—the Gray Code. The table, as in the binary version, shows the bit codes for this sequence and also shows which physical fret is selected for each code in the right-most column. Obviously, the physical fret-to-multiplexer connections would be modified such that the correct physical frets are selected in proper sequence.

As mentioned, the forward sequence of the Gray Code is used in two of the three multiplexers. However, the center multiplexer (for physical frets 08-15) is treated differently. If the center multiplexer were set up to have the same forward sequence of the Gray code, there would be a situation where switching from the upper-most multiplexer to the center multiplexer and from the center multiplexer to the lower-most multiplexer would require two or more bits to change—the multiplexer select bit and three fret select bits. Therefore, this disclosure proposes that the center multiplexer use a novel reversed Gray code as shown in the table. Notice that with this reversed sequence, the switching from the upper-most multiplexer to the center one and from the center one to the bottom-most multiplexer only requires one control bit to change, thus, alleviating the glitch issue.

(L) Ghost Note Prevention

During normal guitar playing, any fretted string rests between two frets—the highest fret and the next lower one. However, during the sequence of coming to rest between those two frets, the string usually comes in contract with one or more lower frets. That is, if a player frets a string at fret 9, the string has possibly come in contact with one or more of the frets 1 through 7 (and most likely, fret 8). In normal guitar playing, this does not create issues but in a scanned system, certain 'ghost notes' may occur. The potential problem sequence is as follows: Since the scanning takes place from high frets to lower frets and since a stopped fret is determined when a string voltage is found to be greater than the scanned fret voltage, a situation can arise where the string is in transition towards a high fret and the scan has already progressed past that point and towards the lower frets. Then, as soon as the string touches the higher fret, a stopped fret indication is decoded. However, the scanner is pointing to the lower fret and the lower fret is erroneously decoded as being the stopped fret.

This situation is not necessarily frequent and although it typically self-corrects itself on the very next scan time, but it still can cause unexpected disruptive short notes to sound. More seriously, when the neck is being used as a mode control input, such erroneous fret number can cause incorrect modes to be selected.

A novel approach to eliminating this problem is now described. The method relies on the fact that if a stopped fret detection is indeed valid, then the fret detection of the fret just before that fret (the next higher fret) will be invalid. So a scanning sequence is introduced whereby each assumed stopped fret detection is immediately followed by a prior-fret verification. If the prior-fret verification yields a stopped fret status, then the original stopped fret detection is assumed to be erroneous. If the prior-fret verification yields a non-stopped fret status, then the original stopped fret detection is assumed to be valid.

This technique impacts the overall scanning time only slightly but allows for a substantially more robust fret scanning results.

Variations to embodiments discussed above can be made without deviating from aspects of the present disclosure discussed herein. Strings could be, for example, scanned in reverse order from the nut to the bridge. Strings could be scanned one fret at a time such as string 1, fret 16; then string 2, fret 16, etc. then string 1, fret 15; string 2, fret 15 etc. The current down the voltage gradient wire could be made to be non-dc if necessary. The current within the voltage gradient wire could be made to flow from the nut-end to the bridge-end of the neck. Further, to minimize current requirements, the current source could be pulsed. That is, for each fret interrogation, the fret and string selections could be made and then the current source enabled. Then, after a short settling time, the output of the frets and strings could be read and the current source then disabled. The performance would appear as if the current source was constant. By applying an capacitive energy storing device to the current source, the average current requirements could be set very low.

This concept is based on the novel approach of applying voltages to the frets instead of relying on current down the actual guitar strings. Various exemplary methods have been described in detail but there are other ways to approach this 'volts' to frets' concept. For example, a discrete voltage could be applied to each fret using voltage sources on each fret; Or, the current source could be progressively moved from the top of the gradient wire down one fret at a time while watching for changes in the selected string voltage; Or, a single fret-width gradient wire, one side fed a current and the other side grounded, could be applied to fret pairs and progressively moved down the neck, again, watching for voltage changes in the strings.

Many of the operations have been described as software modules. For example, the envelope follower. However, without deviating from the basic concept, it should be appreciated that hardware solutions are also viable for such elements. The envelope follower may be implemented using analog switches and capacitors while still retaining the synchronous nature of the updates. Scanning, for example, could be done by counters. The 'slicing', for example, could be done using comparators. Etc. etc. Additionally, the tasks could be segmented in many different ways. For example, using software to sequence the elements and some amount of hardware to support the sequencing.

The MIDI output could be, for example, an interface to a different type of musical generator such as a built-in sample waveform read-out or the like—all of which could be non-MIDI.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A system for determining fretted positions and note onsets of a stringed musical instrument having a bridge, a neck comprising a plurality of frets, and at least one instrument string, the system comprising:

a voltage applicator configured to apply a voltage to at least one fret of the plurality of frets;

a fret multiplexer configured to electrically connect to the at least one fret of the plurality of frets of the stringed musical instrument;

a bridge multiplexer configured to electrically connect to the at least one instrument string at the bridge of the stringed musical instrument;

a voltage analyzer configured to compare a voltage of the at least one instrument string electrically connected to the bridge multiplexer to the voltage of the at least one fret of the plurality of frets electrically connected to the fret multiplexer, the voltage analyzer being further configured to output a voltage analyzer output signal;

a compressor configured to receive the voltage analyzer output signal and to process the voltage analyzer output signal to form a compressed output signal; and a processor configured to receive the compressed output signal, to coordinate string and fret scanning and analysis, and to output at least one of a processed output signal and a multiplex control signal.

2. The system of claim 1, wherein the voltage applicator comprises at least one voltage source.

3. The system of claim 1, wherein the voltage analyzer comprises at least one amplifier and at least one voltage comparator.

4. The system of claim 1, wherein the compressor comprises at least one amplifier configured to operate in a clipping mode.

5. The system of claim 1, wherein the processed output signal includes at least one of a Musical Instrument Digital Interface (MIDI) note or command.

6. A method of determining fretted positions of a stringed musical instrument having a bridge, a neck comprising a plurality of frets and at least one conductive instrument string, and a nut, the method comprising:

applying a fret voltage to at least one fret of the plurality of frets;

providing a string voltage associated with the fret voltage to the at least one conductive instrument string when the at least one conductive instrument string is placed in contact with the at least fret of the plurality of frets;

obtaining the string voltage of the at least one conductive instrument string;

obtaining the fret voltage associated with the at least one fret of the plurality of frets;

comparing the obtained string voltage to the obtained fret voltage to obtain a voltage difference;

determining that the at least one fret of the plurality of frets is in contact with the at least one conductive instrument string based on the voltage difference; and outputting a representation corresponding to the determined contact between the at least one fret of the plurality of frets and the at least one conductive instrument string.

7. The method of claim 6, wherein the applying the fret voltage includes:

applying the fret voltage to the at least one fret by electrically attaching a current-fed conductive wire having a finite resistance to the at least one fret along at a position along the wire, and applying a voltage gradient to the at least one fret, wherein the fed current (i) flows from the bridge to the nut, (ii) flows from the nut to the bridge, (iii) is switched on and off, or (iv) varies in amplitude.

8. The method of claim 6, further comprising applying the fret voltage to a first fret of the at least one frets individually by electrically attaching multiple voltage sources individually to each of the at least one frets.

9. The method of claim 6, wherein the obtaining the string voltage comprises selectively obtaining the string voltage by applying one or more control signals to a multiplexer, wherein at least one input to the multiplexer is the string voltage, and wherein at least one output of the multiplexer corresponds to a selected string voltage.

10. The method of claim 6, wherein the outputting the representation corresponding to the determined contact comprises outputting at least one of a plurality of values representing contact between a selected string and a selected fret, and wherein the plurality of values includes a value representing an absence of contact between the selected string and the selected fret.

11. The method of claim 6, wherein the representation corresponding to the determined contact is at least one of a Musical Instrument Digital Interface (MIDI) note or control information.

12. A stringed instrument configured to permit determination of fretted positions and note onsets, the stringed instrument comprising:

a neck comprising a plurality of frets;

at least one instrument string;

a voltage applicator configured to apply a voltage to at least one fret of the plurality of frets;

a fret multiplexer connected to the at least one fret of the plurality of frets;

a bridge multiplexer connected to the at least one instrument string;

a voltage analyzer configured to compare a voltage of the at least one instrument string electrically connected to the bridge multiplexer to the voltage of the at least one fret of the plurality of frets electrically connected to the fret multiplexer, the voltage analyzer being further configured to output a voltage analyzer output signal;

a compressor configured to receive the voltage analyzer output signal and to compress the voltage analyzer output signal to form a compressed output signal; and a processor configured to receive the compressed output signal, to coordinate string and fret scanning and analysis, and to output at least one of a processed output signal and a multiplex control signal.

13. The stringed instrument of claim 12, wherein the voltage applicator comprises a conductive wire coupled to a current source.

14. The stringed instrument of claim 12, wherein the voltage applicator comprises at least one voltage source coupled to the at least one fret.

15. The stringed instrument of claim 12, wherein the voltage analyzer is a comparator.

16. The stringed instrument of claim 12, wherein the compressor is a combination of an analog-to-digital converter and an input to a processing element.

17. The stringed instrument of claim 12, wherein the processor is configured to sequence at least one of string and fret scanning from string-to-string from a highest fret of the stringed instrument to a lowest fret of the stringed instrument.

18. The stringed instrument of claim 12, wherein the processor is configured to sequence at least one of string and fret scanning from string-to-string and is configured to skip one or more strings when it is determined that no strings are in contact with any of the plurality of frets.

19. The stringed instrument of claim 12, wherein the processor is configured to sequence at least one of string and fret scanning such that a first string in contact with a fret is confirmed by a second, single-fret scan.

20. The stringed instrument of claim 12, wherein the processor is configured to sequence at least one of string and fret scanning using at least one delay following a detection of a string in contact with a fret.

* * * * *